United States Patent [19]

Marco

[11] 4,131,550

[45] Dec. 26, 1978

[54] POLYESTER TEXTILE MATERIALS HAVING IMPROVED DURABLE SOIL RELEASE CHARACTERISTICS AND PROCESS FOR PRODUCING SAME

[75] Inventor: Francis W. Marco, Pauline, S.C.

[73] Assignee: Milliken Research Corporation, Spartanburg, S.C.

[21] Appl. No.: 815,124

[22] Filed: Jul. 13, 1977

[51] Int. Cl.[2] ..... D06M 13/20

[52] U.S. Cl. ..... 252/8.6; 8/115.6

[58] Field of Search ..... 252/8.6; 8/115.6 A

[56] References Cited

U.S. PATENT DOCUMENTS

| | | | |
|---|---|---|---|
| 3,293,178 | 12/1966 | Mac Donald et al. | 252/8.8 R |
| 3,433,666 | 3/1969 | Moyse et al. | 8/115.6 A |
| 3,716,518 | 2/1973 | Pittman et al. | 8/115.6 A |
| 3,912,681 | 10/1975 | Dickson | 8/115.6 A |
| 3,993,830 | 11/1976 | Dickson et al. | 8/115.6 A |

*Primary Examiner*—William E. Schulz

*Attorney, Agent, or Firm*—Glen M. Burdick; H. William Petry

[57] ABSTRACT

Textile materials formed of polyester fibers having improved durable soil release characteristics are provided by applying to the textile material an effective amount of an aqueous emulsion consisting essentially of from about 0.25 to about 25 weight percent of a synthetic acid emulsion polymer and at least 0.01 weight percent of a water-soluble salt in which the cation moiety of the salt is a polyvalent metal ion of magnesium, barium or calcium and the anion moiety is a halogen or the anion moiety of a weak organic acid in which the pK value of such acid is from about 3 to about 5. The synthetic acid emulsion polymer is further characterized as having at least about 20 weight percent acid calculated as acrylic acid. The before-mentioned aqueous emulsion is applied to the textile material in an amount sufficient to provide at least about 0.05 weight percent solids on the textile material, such solids being a combination of the emulsion polymer and the salt constituent. The resulting wet textile material is thereafter dried to remove substantially all of the water and thereafter the dry textile material is heated to a temperature of from about 280° F to about 450° F for a time sufficient to cure the polymer containing the salt constituent.

9 Claims, No Drawings

POLYESTER TEXTILE MATERIALS HAVING IMPROVED DURABLE SOIL RELEASE CHARACTERISTICS AND PROCESS FOR PRODUCING SAME

This invention relates to textile materials formed of polyester fibers having durable soil release characteristics. In one aspect it relates to a method for imparting durable soil release characteristics to a textile material formed of polyester fibers.

The genesis of synthetically produced textile fibers has brought about a tremendous effort in the textile industry along numerous avenues. There has been much research effort directed to the improvement of these synthetic fibers, especially the polyester fibers to improve the soil release characteristics of textile materials produced from such fibers without adversely effecting the hand of the textile material. Of major concern has been the difficulty of cleaning garments made from polyester fibers using conventional home washing procedures due to the oleophilic nature of the garments made from textile materials of polyester fibers. Thus, numerous efforts have been proposed to alter the oleophilic properties of the textile material produced from polyester fibers so that dirt and/or oily deposits on the soiled clothes can readily be removed by such a home washing procedure. However, in altering the oleophilic characteristics of the textile material care must be exercised to insure that the hand of the fabric does not become hard which would result in discomfort to the wearer of the garment.

In attempting to solve the problem of soiling in synthetic fabrics a substantial amount of research has been conducted and numerous patents have issued as a result thereof. Further, much effort has been directed to the use of blends containing synthetic fibers and naturally occurring fibers in order to produce a resulting blend which possesses the desired soil release properties and the desired hand properties. Thus, attempts have been made to reduce the oleophilic characteristics of synthetic fibers, such as polyester, by coating the fibers with a coating that is oleophobic, i.e., one which will hinder the attachment of soil or oily materials to the fiber. Many polymer systems have been proposed which are capable of forming a film around the fibers that constitute the textile material, particularly acid emulsion polymers prepared from organic acids having reactive points of unsaturation. Typical of such acid emulsion polymers is set forth in U.S. Patent 3,377,249 wherein soil release and durable press characteristics of linear polyester fibers are improved by application of an admixture comprising an amino-plast textile resin, a textile resin catalyst and a synthetic acid emulsion polymer. The resulting resin composition, so applied, is thereafter cured.

In addition, efforts have been made to improve the soil release characteristics of synthetic fibers during the conventional home washing operation. Such a process is set forth in U.S. Pat. 3,798,169 wherein a polycarboxylate polymer having an acid equivalent weight of from about 110 to 175 is precipitated from a dilute solution containing such polymer by the use of a water soluble salt of a polyvalent metal. Thus, the solution polymer is caused to be deposited upon the fabric during the final rinse cycle in the home cleaning process.

However, even in view of the above and numerous other processes and compositions which have heretofore been advanced by the prior art research is constantly being conducted to develop new and improved compositions and processes for imparting durable source soil release characteristics to polyester fibers and to textile materials formed therefrom so that garments made of polyester textile materials can readily be cleaned in both a home washing operating and a commercial cleaning process. Accordingly, by virture of the teachings of the present invention, problems historically present with the use of garments produced from textile materials of polyester fibers are substantially alleviated and a durable soil release characteristic is achieved.

It is therefore an object of the present invention to provide a textile material formed of polyester fibers having durable soil release characteristics. Still another object of the present invention is to provide a process for imparting durable soil release characteristics to textile materials formed of polyester fibers. These and other objects may be readily seen from the following detailed description of the present invention.

Generally speaking, the present invention is directed to textile materials formed of polyester fibers having durable soil release characteristics and to a process for producing same. Broadly, such is achieved by applying to the textile material an effective amount of an aqueous emulsion consisting essentially of from about 0.25 to about 25 weight percent of a synthetic acid emulsion polymer and at least 0.1 weight percent of a water-soluble salt in which the cation moiety of the salt is a polyvalent metal ion selected from the group consisting of $Mg^{++}$, $Ba^{++}$ or $Ca^{++}$ and the anion moiety is a halogen, such as $Cl^-$ or the anion moiety of a weak organic acid in which the pK value of such acid is from about 3 to about 5. While the amount of aqueous emulsion employed can vary widely sufficient of the aqueous emulsion should be used so that the textile material is sufficiently wet with the aqueous emulsion so as to provide at least about 0.5 weight percent solids on said material, such solids being the combination and in the before-mentioned ratio of the acid emulsion polymer and the water-soluble salt constituent. The wetted fabric is then dried for a period of time sufficient to remove substantially all of the water and thereafter the dried polymer-salt coated textile material is heated to a temperature sufficient to cure the polymer containing the salt constituent on the textile substrated. The temperature at which such curing is carried out can vary widely but will generally be in a range of from about 280° F. to about 450° F. Especially desirable results can be obtained when the polymer is employed in the emulsion in an amount of from about 0.15 to about 4 weight percent and the salt constituent is present in the emulsion in an amount of from about 0.05 to about 0.4 weight percent. Further, it is desirable that sufficient of the aqueous emulsion be employed to provide from about 0.25 to about 5 weight percent solids on the textile material, e.g., solids being the polymer constituent and the salt constituent.

pK value is used herein can be represented by the formula $pK = -\log_{log}K$ wherein K is the dissociation constant of the acid in an aqueous solution. Typical of weak organic acids having a pK value of from about 3 to about 5 in which the anion moiety of such acid can be employed as the anion moiety of the before-defined water-soluble salt are as follows:

| Acid | pK value |
|---|---|
| acetic | 4.75 |
| formic | 3.75 |
| propionic | 4.87 |
| butyeric | 4.8 |
| citric | 3.08 and 4.7 |
| maleic | 3.00 |
| acrylic | 42.5 |

The synthetic acid emulsion polymer useful in the practice of the present invention may be selected from a large number of synthetically produced compounds provided that at least about 20 percent of the acid polymer is acid calculated as acrylic acid. Further, the synthetic acid emulsion polymer employed advantageously is capable of forming a film around the polyester fibers that constitute the textile material.

Synthetically produced acid emulsion polymers within the scope of the present invention may be prepared from any of the polymerizable organic acids, i.e., those having reactive points of unsaturation. These polymers may be interpolymers of the acid and other monomers copolymerizable therewith so long as at least 20 weight percent acid monomer is present in the polymer. Exemplary of polymerizable acids that may be used, are acrylic acid, maleic acid, fumaric acid, methacrylic acid, itaconic acid, crotonic acid, cinnamic acid, polymerizable sulfonic acids, polymerizable phosphoric acids, etc. Monomers that may be interpolymerized with the acids include any monomers capable of copolymerizing with the acids and which will not detrimentally effect the film-forming properties of the polymer. Suitable monomers include, esters of the above acids prepared by reacting the particular acid with an alkyl alcohol, e.g., ethyl acrylate, methyl acrylate, propyl acrylate, isopropyl acrylate, methyl methacrylate, ethyl methacrylate, 2-ethylhexyl acrylate, butyl acrylate, etc.; alkyl fumarates, maleates, crotonates, cinnamates, etc.; vinyl halides, monomers having vinylidene groups and substituted vinyl monomers, and the like. In all of the polymers perpared from the above listed monomers, there must be at least 20 weight percent acid calculated as acrylic acid. It should be noted that various mixtures of the above polymers will work according to the process of the present invention and hence should be considered within the scope of the present invention.

Examples of some of the synthetic acid polymers that may be used according to the present invention are polymerization products of:

ethyl acrylate:acrylic acid
ethyl acrylate:acrylic acid:acrylamide
butyl acrylate:acrylic acid
ethyl acrylate:methacrylic acid
ethyl acrylate:itaconic acid
methyl methacrylate:acrylic acid
2-ethyl hexyl acrylate:acrylic acid
butyl acrylate:acrylic acid:acrylamide
ethyl acrylate:acrylic acid:N-methylol acrylamide
ethyl acrylate:acrylic acid:styrene
ethyl acrylate:acrylic acid:hydroxy propyl methacrylate
ethyl acrylate:acrylic acid:divinyl benzene
ethyl acrylate:acrylic acid:allyl acrylamide
ethyl acrylate:acrylic acid:glycidyl acrylate
ethyl acrylate:itaconic acid
ethyl acrylate:sodium sytrene sulfonate
ethyl acrylate:crotonic acid
styrene:acrylic acid
ethyl acrylate:acrylic acid:hydroxy ethyl methacrylate
hydroxy ethyl methacrylate:acrylic acid:acrylamide
butyl acrylate:ethyl acrylate:acrylic acid and the like.

Some acid emulsion polymers work better than other, however, and these are preferred. Especially desirable results have been obtained wherein the emulsion polymer is an emulsion terpolymer prepared by emulsion polymerizing a monomeric mixture comprising an acrylic ester, an acrylic acid, and a cross-linking monomer containing at least one vinyl group per molecule. While the amount of each of the monomer constituents in the monomeric admixture can vary widely, especially desirable results have been obtained when the monomeric mixture comprises from about 20 to about 80 parts of the acrylic ester, from about 80 to about 20 parts of an acrylic acid, and from about 0.5 to about 10 parts of the cross-linking monomer. Typical of the cross-linking monomer employed in the terpolymer are N-methylol acrylamide, N-methylol methacrylamide and glycidyl acrylate.

The water-soluble salts having a polyvalent metal cation selected from the group consisting of $Mg^{++}$, $Ba^{++}$ or $Ca^{++}$ and an anion moiety selected from the group consisting of halogen or an anion moiety of a weak organic acid in which the pK value for said acid is from about 3 to about 5 useful in the practice of the present invention may be selected from a large number of inorganic and organic salts provided the cation and anion moieties are as previously stated. Further, such water-soluble salts must not severely alter the film forming properties of the synthetic acid emulsion polymer or alter its characteristics sufficiently to form a hard, brittle film. Exemplary of inorganic water-soluble salts that may be used are magnesium chloride, magnesium bromide, magnesium iodide, barium chloride, barium bromide and barium iodide, calcium chloride, calcium bromide and calcium iodide. Typical of organic water-soluble salts that may be used are magnesium acetate, calcium acetate, magnesium formate, calcium formate, magnesium citrate, calcium citrate, barium acetate, barium formate, barium citrate, and the like. It should also be noted that various mixtures of the above-described water-soluble salts will work according to the process of the present invention and hence should be considered within the scope of the present invention.

The combination of the acid emulsion polymers and the before-defined wate-soluble salts suitable for use in practicing the present invention form a hydrophilic film upon drying. However, if one desires to impart durable soil release characteristics to the polyester fibers of the textile substrate it has been found necessary to cure the polymer containing the salt constituent. Any suitable curing procedure can be employed. However, it is generally desirable that the textile material containing the polymer and the salt constituent first be dried to remove water. Thereafter, the dried fabric is heated to a temperature of about 280° F. to about 450° F. for a period of time sufficient to substantially cure the polymer. Employing such curing procedure has proven to substantially enhance the durablility of the soil release characteristics imparted to the polyester fibers of the textile substrate by the acid emulsion polymer and the before-mentioned salt constituent.

As previously stated, the polymer constituents useful in the practice in the present invention are the acid emulsion polymers and thus as such contains varying amounts of solids. Normally, it is desirable that the aqueous emulsion polymer contain from about 0.25 to about 25 weight percent solids of the synthetic acid emulsion polymer. Further, sufficient water-soluble salt is incorporated into the aqueous emulsion so as to provide at least 0.1 weight percent of the water-soluble salt consituent, preferably from about 0.05 to about 0.4 weight percent. The aqueous emulsion consisting essentially of the synthetic acid emulsion polymer and the water-soluble salt in which the cation and anion moiety are as previously defined should be present in the pad bath or other application medium in a sufficient amount so that at least 0.05 weight percent of acid polymer solids and water-soluble salt is applied to the substrate, based on the dry weight of the textile substrate, and preferably from about 0.25 to about 5 weight percent.

The bath used to impregnate the textile material according to the present invention is not limited to include only the essential ingredients heretofore mentioned, e.g., the synthetic acid emulsion polymer and the water-soluble salt of the before-mentioned polyvalent ion. In addition, other non-essential ingredients may be employed such as, for example, emulsifying agents, wetting agents, softners, and the like and numerous other compounds that enhance the physical characteristics of the fabric. The bath may be applied to the substrate in any suitable manner. For instance, padding of the bath onto fabric is preferred because of the ease of operation as this particular stage of development. However, the aqueous emulsio containing the synthetic acid emulsion polymer and the before-described water-soluble salt constituent may be sprayed onto the substrate or the substrate may be merely dipped into the aqueous emulsion.

In employing the process of the present invention it is preferred, as previously stated, that one remove the water from the wetted textile substrate prior to curing the polymeric constituent containing the salt constituent onto the textile substrate. The drying temperatures employed should be sufficient to economically and effectively remove the water constituent of the aqueous emulsion but should be insufficient to initiate curing of the polymer and salt constituent. In general, however, the drying step can be accomplished by subjecting the wet textile material to elevated temperatures ranging from about 225° F. to about 350° F. for a period of time effective to remove substantially all of the water from the textile material. The drying temperature range set forth over-laps to some degree with the curing temperature range. When drying in the over-lapping portion of the drying and curing temperature ranges, it is important that there be no premature curing of the synthetic acid emulsion polymer containing the before-defined water-soluble salt. Thus, time may be a prime variable and when drying the substrate in the higher end of the drying temperature range, care must be taken to avoid heating the substrate for time sufficient to initiate the curing of the polymer constituent.

In order to more explicitly illustrate the subject invention, the following examples are given. These examples are not intended to limit the scope of the present invention but are merely set forth to provide direction to one skilled in the art. Unless otherwise stated, parts set forth in the examples are parts by weight.

EXAMPLE 1

A series of experiments were conducted in which a plurality of pad bath solutions were prepared, each of the pad baths containing water, 2 percent of an emulsion copolymer containing 15 percent solids and 2 percent of a water-soluble salt as indicated in the following table. Each of the solutions were padded onto samples of 100 percent textured polyester double knit fabric to 100 percent wet pickup and the fabric was then dried at a temperature of 250° F. for 4 minutes and thereafter the polymer constituent was cured at 370° F. for 1½ minutes. The treated fabrics contained 0.3% of the polymer constituent and 0.2% of the salt. Each sample was then stained with used crankcase motor oil, washed and rated. The rating was on a scale of 1 to 7, 1 representing substantially no improvement over untreated fabric and 7 representing excellent soil release properties. A second series of experiments were conducted using the before-described procedure except that each sample was washed and dried 4 times before being stained with the used crankcase motor oil. After staining, the samples were washed for the 5th time and rated. These ratings are evidence of the durability of the soil release finish. The results of these experiments are set forth in Table I. The anion moiety (Ac) of the salt constituents as used hereafter is to be understood to be the acetate anion, e.g.

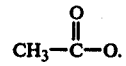

$$CH_3-\overset{\overset{\displaystyle O}{\|}}{C}-O.$$

TABLE I

| Salt | Soil Release 1 Wash | Soil Release 5 Washes |
|---|---|---|
| Control - (untreated fabric) | 1.0 | 1.0 |
| None [1] | 1.0 | 1.0 |
| $MgCl_2$ 6 $H_2O$ | 5.0 | 3.8 |
| $BaCl_2$ 2 $H_2O$ | 5.5 | 3.0 |
| $Zn(Ac)_2$ 2 $H_2O$ | 1.0 | 1.0 |
| $Zn(Cl)_2$ | 1.0 | 1.0 |
| $Zn(Ac)_2$ + 1% Acetic Acid | 1.8 | 1.0 |
| $Mg(SO_4)_2$ 7 $H_2O$ | 4.5 | 1.5 |
| $Mg(NO_3)_2$ 6 $H_2O$ | 4.5 | 1.0 |
| $Cd(Ac)_2$ 2 $H_2O$ | 1.0 | 1.0 |
| $Al(NO_3)_3$ 9 $H_2O$ | 3.5 | 1.3 |
| $Ca(NO_3)_3$ 4 $H_2O$ | 3.8 | 1.0 |
| $MnCl_2$ 4 $H_2O$ | 1.0 | — |

[1] Polymer but no salt applied to fabric.

EXAMPLE II

A second series of experiments were conducted using the same procedure of Example I with the exception that the pad baths, in addition to coating, contained 0.1 percent of various salt constituents and/or 2 percent of the emulsion copolymer of Example I. Further, two different samples of 100 percent textured polyester double knit fabrics were padded, dried and cured. The results below are the average value of the measurements made on the two samples. The effectiveness of the soil release properties and durability of same were rated on a scale of 1 to 5, 1 representing substantially no improvement over untreated fabric and 5 representing excellent soil release properties and durability of same. Results of these experiments are set forth in Table II.

TABLE II

| Salt Type | % of Salt | Soil Release 1 Wash | Soil Release 5 Washes |
|---|---|---|---|
| [1] 0–1% $Mg(Ac)_2$-4$H_2O$ | 0.1 | 1 | 1 |
| [2] None | 0 | 1 | 1 |
| $Mg(Ac)_2$-4$H_20$ | 0.1 | 3.15 | 3.75 |
| $MgCl_2$-6$H_2O$ | 0.1 | 1.65 | 2.15 |

TABLE II-continued

| Salt Type | % of Salt | Soil Release 1 Wash | Soil Release 5 Washes |
|---|---|---|---|
| $Ca(Ac)_2$ | 0.1 | 2.9 | 3.4 |

(1)no polymer constituent present in pad bath
(2)no salt only polymer constituent

EXAMPLE III

A series of experiments were conducted to determine the effect of curing of the polymer-salt composition on durability. A pad bath was prepared containing water, 2% of an emulsion terpolymer prepared by emulsion polymerization of 80 parts methyl acrylate, 20 parts acrylic acid and 1.2 parts N-methylol acrylamide and 0.25% $Mg(Ac)_2 - 4\ H_2O$. The solution was padded onto samples of 100% textured polyester double knit fabric to 100% wet pickup and the fabric was dried at 250° F. for 4 minutes. Thereafter various samples were subject to different curing temperatures for 1½ minutes. The treated samples, each containing 0.3% of the terpolymer and 0.25% of the salt was stained with used crankcase motor oil washed 5 times and rated. The rating was on a scale of 1 to 5 as set forth in Example II. The results of these experiments are set forth in Table III.

TABLE III

| Curing Temp. ° F | Rating |
|---|---|
| None | 2 |
| 300 | 3.5 |
| 325 | 5.0 |
| 350 | 5.0 |
| 375 | 5.0 |
| 400 | 5.0 |

EXAMPLE IV

A series of experiments were conducted to determine if the salt constituent was being preferentially absorbed from the pad bath by the fabric and to also determine the presence of the salt constituent on the dried, cured fabric. To determine if the fabric was preferentially absorbing the salt constituent atomic absorption measurements were made on the pad bath before and after padding the sample. The results of these measurements were as follows:

| | Pad Bath | Atomic Absorption Readout (% $Mg(Ac)_2 . 4\ H_2O$) Before Padding | After |
|---|---|---|---|
| I. | water 2% of copolymer of Example I 0.25% $Mg(Ac)_2 . 4\ H_2O$ | 0.25 | 0.25 |
| II. | water, 2% terpolymer of Example III, 0.25% $Mg(Ac)_2 . 4\ H_2O$ | 0.26 | 0.25 |

The above data shows that there was no substantial depletion of the $Mg(Ac)_2 . 4\ H_2O$ salt constituent from the pad bath due to preferential absorption of such salt constituent by the fabric.

The fabric padded through each of the before-mentioned pad baths was then measured for magnesium content, both before and after washing, using an atomic absorption measuring technique. The results of such measurements are tabulated below.

| Pad Bath | Atomic Absorption Readout Before Washing | After 5 washes |
|---|---|---|
| I | 0.22 | 0.02 |

-continued

| Pad Bath | Atomic Absorption Readout Before Washing | After 5 washes |
|---|---|---|
| II | 0.21 | 0.02 |

The above data, within experimental error, clearly shows the presence of the salt constituent on the fabric both before and after 5 washing. Further, although the amount of salt constituent is reduced after 5 washings, the amount of reduction is only about 10 percent of the amount of the salt constituent originally present on the fabric before washing.

Thus, the above data clearly indicates that when one employs the unique combination of polymer constituent and the particular type of salt constituent one obtains a synergistic effect as to durable soil release properties.

Having thus described the invention, I claim:

1. A process for imparting durable soil release characteristics to a textile material formed of polyester fibers which comprises padding a textile material with an effective amount of an aqueous emulsion consisting essentially of from about 0.15 to about 4 weight percent of a synthetic acid emulsion polymer, said polymer having at least about 20 weight percent acid calculated as acrylic acid, and from about 0.05 to about 0.4 weight percent of a water-soluble salt wherein the cation moiety of said salt is a polyvalent metal ion selected from the group consisting of $Mg^{++}$, $Ba^{++}$, and $Ca^{++}$ and the anion moiety of said salt is selected from the group consisting of halogen and the anion moiety of an organic acid in which the pK value of said organic acid is from about 3 to about 5 so as to provide a resulting wet textile material containing from about 0.25 to about 5 weight percent solids, said solids being a combination of said polymer and said salt; drying said resulting wet textile material for a period of time sufficient to remove substantially all of the water therefrom; and, heating the dry textile material to a temperature of from about 280° F. to about 450° F. for a time sufficient to cure said polymer containing said salt.

2. The textile material having durable soil release characteristics prepared according to the process of claim 1.

3. The process of claim 1 wherein said emulsion polymer is an emulsion terpolymer prepared by emulsion polymerizing a monomeric mixture comprising an acrylic ester, an acrylic acid, and a cross-linking monomer containing at least one vinyl group per molecule.

4. The textile material having durable soil release characteristics prepared according to the process of claim 3.

5. The process of claim 3 wherein said cross-linking monomer is selected from the group consisting of N-methylol acrylamide, N-methylol methacrylamide and glycidyl acrylate.

6. The process of claim 5 wherein said terpolymer is prepared by emulsion polymerizing a monomeric mixture comprising 20 to 80 parts of an acrylic ester, 80 to 20 parts of an acrylic acid and 0.5 to 10 parts of said cross-linking monomer.

7. The textile material having durable soil release characteristics prepared according to the process of claim 6.

8. The process according to claim 7 wherein said terpolymer is prepared by emulsion polymerization of 80 parts methyl acrylate, 20 parts acrylic acid, and 1.2 parts N-methylol acrylamide and said salt is magnesium acetate.

9. The textile material having durable soil release characteristics prepared according to the process of claim 8.

* * * * *

CERTIFICATE OF CORRECTION

Patent No. 4,131,550 Dated December 26, 1978

Inventor(s) Francis W. Marco

It is certified that error appears in the above-identified patent and that said Letters Patent are hereby corrected as shown below:

Column 1, line 26, after the word "that" insert --the--.

Column 2, line 48, the word "substrated" should be --substrate--.

Column 2, line 62, the word "is" should be --as--.

Column 2, line 63, the word "$\log_{\log} K$" should be --$\log_{10} K$--.

Column 3, line 4, the numeral "42.5" should be --4.25--.

Column 3, line 33, the word "effect" should be --affect--.

Column 3, line 42, the word "perpared" should be --prepared--.

CERTIFICATE OF CORRECTION

Patent No. 4,131,550 (continued) Dated December 26, 1978

Inventor(s) Francis W. Marco

It is certified that error appears in the above-identified patent and that said Letters Patent are hereby corrected as shown below:

Column 3, line 67, the word "sytrene" should be --styrene--.

Column 4, line 6, the word "other" should be --others--.

Column 4, line 49, the word "wate-soluble" should be --water-soluble--.

Column 4, line 68, the word "contains" should be --contain--.

Column 5, line 30, the word "emulsio" should be --emulsion--.

CERTIFICATE OF CORRECTION

Patent No. 4,131,550 (continued) Dated December 26, 1978

Inventor(s) Francis W. Marco

It is certified that error appears in the above-identified patent and that said Letters Patent are hereby corrected as shown below:

Column 6, between lines 25 and 30, correct the structure to read as follows:

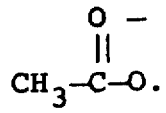

Column 7, line 50, after the word "After" insert the word --Padding--.

Column 7, line 66, after the word "Readout" insert the following --(% $Mg(Ac)_2 \cdot 4\ H_2O$)--.

Column 8, line 2, after the word "Readout" insert the following --(% $Mg(Ac)_2 \cdot 4\ H_2O$)--.

UNITED STATES PATENT OFFICE

CERTIFICATE OF CORRECTION

Patent No. 4,131,550 (continued) Dated December 26, 1978

Inventor(s) Francis W. Marco

It is certified that error appears in the above-identified patent and that said Letters Patent are hereby corrected as shown below:

Column 8, line 9, the word "washing" should be --washings--.

Signed and Sealed this

*Eleventh* Day of *December 1979*

[SEAL]

*Attest:*

SIDNEY A. DIAMOND

*Attesting Officer*

*Commissioner of Patents and Trademarks*